United States Patent [19]

Song

[11] Patent Number: 4,901,892

[45] Date of Patent: Feb. 20, 1990

[54] TAMPER EVIDENT CONTAINER CLOSURE

[75] Inventor: John S. Song, Evanston, Ill.

[73] Assignee: Magenta Corporation, Chicago, Ill.

[21] Appl. No.: 222,936

[22] Filed: Jul. 22, 1988

[51] Int. Cl.[4] ..... B65D 5/72

[52] U.S. Cl. ..... 222/498; 222/506; 222/541; 222/543; 222/556

[58] Field of Search ..... 222/498, 541, 153, 545, 222/543, 556, 506; 215/235, 253, 254; 220/258

[56] References Cited

U.S. PATENT DOCUMENTS

| | | | |
|---|---|---|---|
| 3,434,620 | 3/1969 | Laurizio | 220/258 |
| 3,850,350 | 11/1974 | Towns et al. . | |
| 3,881,639 | 5/1975 | Herip | 222/498 X |
| 4,607,768 | 8/1986 | Taber et al. . | |
| 4,699,290 | 10/1987 | Adams | 220/258 |
| 4,724,978 | 2/1988 | Cleevey et al. | 220/258 |
| 4,760,931 | 8/1988 | Gach | 215/235 |

*Primary Examiner*—Kevin P. Shaver

*Assistant Examiner*—Gregory L. Huson

*Attorney, Agent, or Firm*—Laff, Whitesel, Conte & Saret

[57] ABSTRACT

A tamper evident container closure has a skirt for permanent attachment to the mouth end of a container and a closure crown supported by the skirt. A cover on the closure is displaceable for exposing a well on the closure crown normally closed by the closure. The well has a floor which may be part of a crown panel of the container closure and the well floor has a dispensing opening therein. A rip-out tamper evident element is fixed in closing relation to the opening and requires destructive removal for dispensing access to the opening. A digitally manipulatable handle attached to the element is confined within the well in the closed condition of the cover and is accessible when the cover is displaced from the well for digital manipulation of the handle for forcibly destructively displacing the element from the opening. The portion of the cover over the well may have a sealing surface engageable about the well in the closed position of the cover.

14 Claims, 2 Drawing Sheets

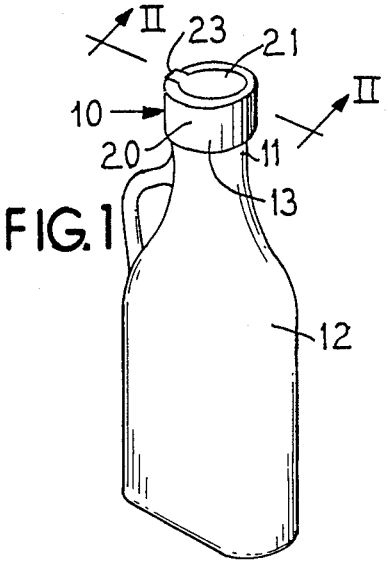
FIG. 1
FIG. 2
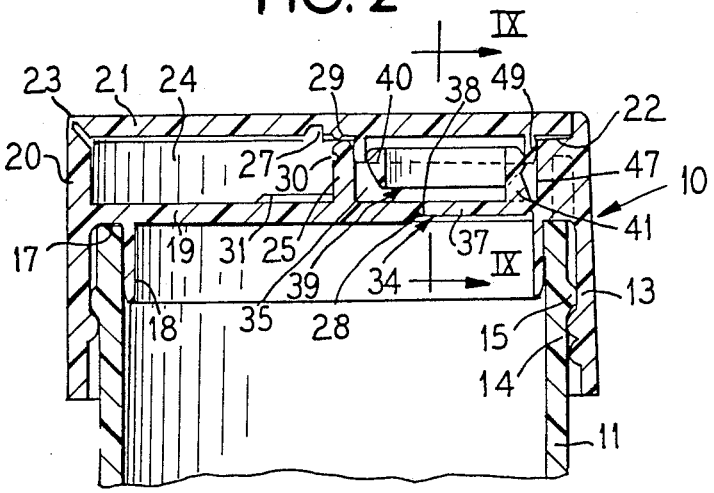
FIG. 3
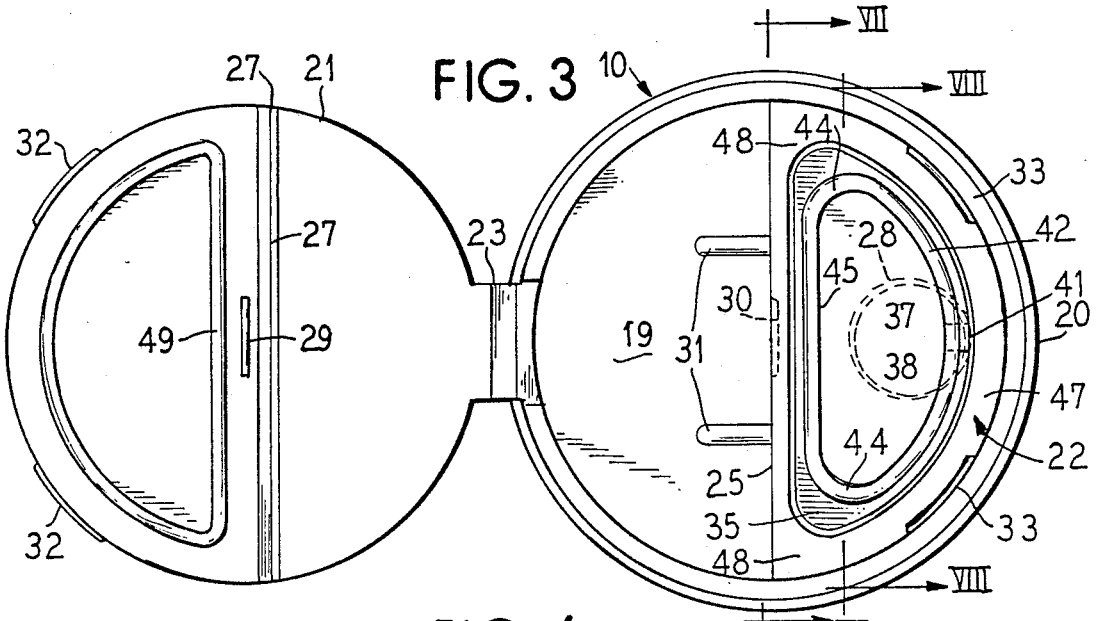
FIG. 4
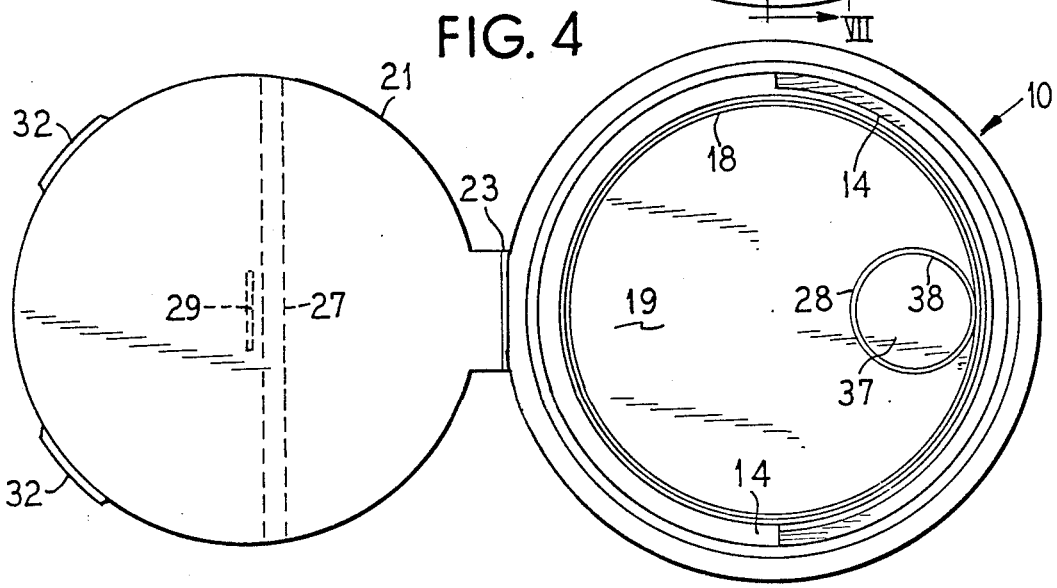

TAMPER EVIDENT CONTAINER CLOSURE

BACKGROUND OF THE INVENTION

This invention relates in general to tamper evident container closures of the kind disclosed in U.S. Pat. No. 4,607,768 in which a cover is hingedly disposed over dispensing openings formed in a raised panel. There are means for snap latched retention of the cover in its closed condition, and means are provided for easy pressure sensitive opening of the cover to permit dispensing from the openings. Anyone having access to the closure can open the same for dispensing contents of a container to which the closure is applied. No means are provided in the patented disclosure for indicating whether the closure has been tampered with, that is, whether unauthorized access has been gained through the closure to the contents of the associated container.

SUMMARY OF THE PRESENT INVENTION

It is accordingly an important object of the present invention to provide a new and improved tamper evident container closure.

Another object of the invention is to provide such a closure which presents a substantial improvement on the kind of closure disclosed in said U.S. Pat. No. 4,607,768.

In accordance with the principles of the present invention, there is provided a tamper evident container closure, including a skirt for permanent attachment to the mouth end of a container and a closure crown supported by the skirt, and a cover on the closure over the crown displaceable for exposing the crown, a wall of substantial depth on the closure crown normally closed by the cover, the well having a floor comprising part of the crown and with a dispensing opening in the floor, a rip-out tamper evident element fixed in closing relation to the opening and requiring destructive removal for dispensing access to the opening, and a digitally manipulatable handle attached to the element and confined within the wall in the closed condition of the cover and accessible when the cover is displaced from the well for pulling the handle out of the well and forcibly destructably displacing the element from the opening.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

FIG. 1 is a perspective view of a container equipped with a tamper evident closure embodying the present invention;

FIG. 2 is an enlarged fragmentary sectional detail view taken substantially along the line II—II in FIG. 1;

FIG. 3 is a top plan view showing the closure of FIG. 2 with the cover thereof in its open position;

FIG. 4 is a bottom plan view of the closure with the cover in open position;

DETAILED DESCRIPTION

Figure 5:
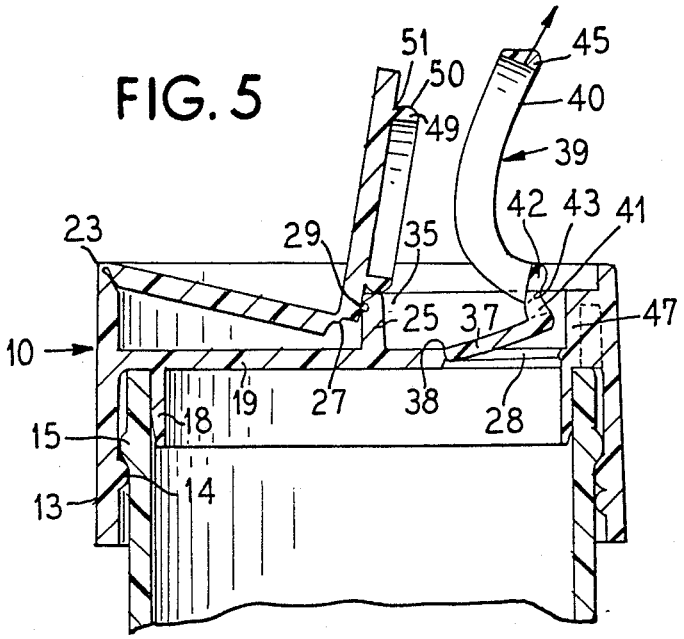
FIG. 5 is a view similar to FIG. 2 but showing the cover partially open and the tamper evident seal partially displaced.

On reference to FIGS. 1 and 2, a tamper evident closure 10 embodying the present invention is depicted as attached in contents controlling relation to the discharge or mouth end of a neck 11 of a container 12 which may be of a generally bottle configuration and adapted for handling fluid or fluent materials of whatsoever nature that may be handled in this type of container.

In a best mode form, the closure 10 comprises a preferably one-piece molded construction made from a suitable plastic material of any preferred kind adaptable for this purpose. Material of this nature is well known and provides a satisfactory self-sustaining structure with desirable resiliency in those portions of the structure that can benefit therefrom.

For attachment of the closure to the container, the closure has a skirt 13 of suitable diameter such that it can be engaged permanently with the upper end portion of the container neck 11. In one such arrangement, the internal surface of the skirt has screw-on or snap-on rib means 14 cooperating with complementary rib means 15 on the external surface of the neck 11 for permanently retaining the skirt and thereby the closure 10 as a whole permanently in place on the container neck.

For maintaining a stable centered relation of the generally cap-shaped closure 10 in place on the container neck, the rim of the neck is received in an annular downwardly opening groove 17 defined within an upper end portion of the skirt 13 by an annular depending centering flange 18 which is spaced radially inwardly from the body of the skirt and is dimensioned to slidably sealingly engage within the upper end of the neck 11. A crown panel 19 area integral with the skirt 13 rests, within the channel 17, firmly on the top edge of the neck 11 and cooperates with the flange 18 in sealing against leakage of contents from the associated container.

An annular upwardly projecting lip structure 20 on the crown 19, aligned with the skirt 13, seats a cover disk 21 which is constructed and arranged to be openable when it is desired to dispense contents from the associated container 12. For this purpose, the cover disk 21 has a diameter to seat with a generally rabbet groove 22 in the upper edge of the lip structure 20 and an integral resilient hinge 23 connects the cover to the lip structure 20.

To facilitate opening the cover 21, generally half of the cover adjacent to the hinge 23 is located in the closed condition of the cover over a clearance cavity 24 defined by a generally diametrical partition 25 integral with the upper side of the crown 19 and the lip structure 20. A hinge groove 27 extending generally diametrically across the inner side of the cover disk 21 over the cavity 24 adjacent to the partition 25 divides the cover into first and second portions and enables the first portion of the cover 21 over the cavity 24 to be pressed manually down into the cavity 24 which provides a clearance for this purpose as shown in FIG. 5. Concurrently, the remaining or second portion of the cover 21 is caused by its engagement with the fulcrum provided by the upper edge of the partition 25 to tilt upwardly so as to expose the remainder of the crown 19 in which there is a dispensing opening 28. For avoiding undesired springing back of the cover to its closed position, a rib and groove detent latch is provided comprising a detent rib 29 adjacent to the hinge groove 27 and which is in the open position of the cover received in a latch groove 30. Although the cover may be retained in this position while dispensing, if preferred, the cover may be fully opened about the hinge 23 and extended away from the lipt structure 20, as shown in FIG. 3.

For reinforcement of the crown panel 19, reinforcing ribs 31 integral with this panel and the partition 25 may be provided.

For retaining the cover 21 on its seat in the closed position, it may be provided with projecting limited length latch ribs 32 on its edge remote from the hinge 23. These ribs 32 releasably engage with complementary latching shoulders 33 formed on the wall provided by the lip structure 20 about the seating groove 22.

New and improved destructably releasable tamper evident seal means 34 is provided for the dispensing opening 28, within a second well 35 on the opposite side of the partition 25 from the wall 24. The dispensing opening 28 is formed in the floor provided by the crown panel 19 in the bottom of the well 35. The seal means 34 comprises a seal disk or stopper element 37 which is initially integrally connected to one piece with the panel 19 by means of line of weakening 38 extending entirely about the diameter of the stopper 37.

The only way to gain access into the container and past the closure 10 is to remove the stopper 37. Means are provided for accomplishing this in the form of a handle 39 desirably comprising a ring 40 connected to the stopper 37 as by means of a more or less resilient post 41 projecting upwardly from the stopper 37. Preferably the post 41 is located on that sector of the stopper 37 which is remote from the partition 25 and thus on that margin of the stopper 37 which is centered with respect to, and as closely adjacent as practicable to, the arc of the wall defining the well 35 opposite the partition 25. At its base, the post 41 is of substantial thickness or mass so as to provide a virtually fail-safe connection with the stopper 37 so that the fracturable or rupturable integral thinning connection 38 of the stopper 37 to the crown panel 19 about the edge of the dispensing opening 28 can be of sufficient strength to curtail casual displacement force applied to the stopper stopper 37, but permit fracture and removal displacement of the stopper when adequate tearaway leverage force is applied by an outward pull exerted by means of the handle 40 on the post 41.

Figure 6:
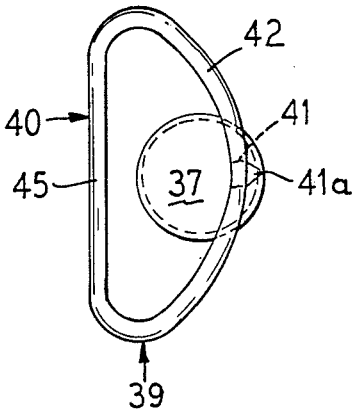
FIG. 6 is a top plan view of the tamper evident seal and its hingedly attached manipulating handle.
Figure 7:
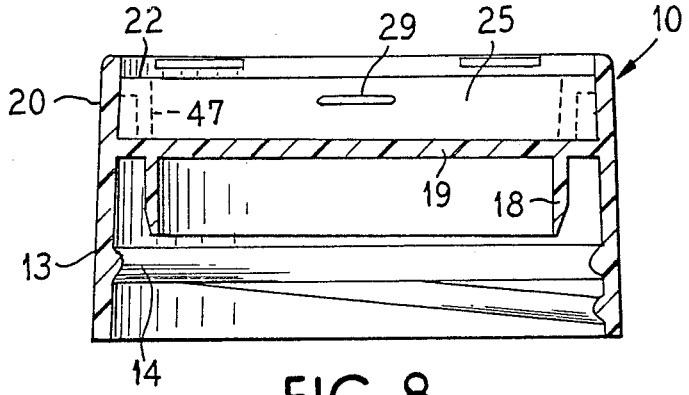
FIG. 7 is a vertical sectional detail view taken substantially along the line VII—VII in FIG. 3.
Figure 8:
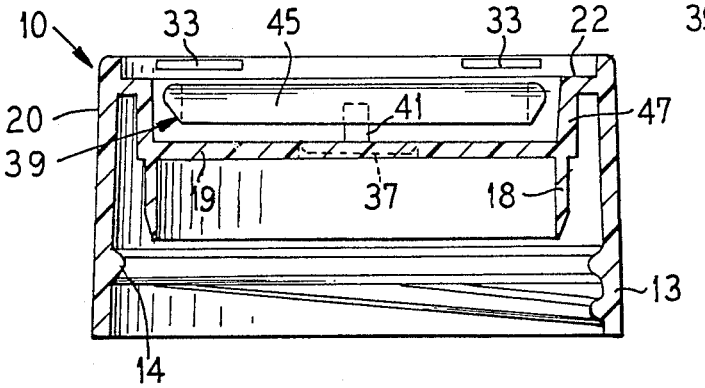
FIG. 8 is a vertical sectional detail view taken substantially along the line VIII—VIII in FIG. 3.

If desired, the port 41 may be pointed as shown at **41*a* of FIG. 6 with the point at the score line or connection 38. In this manner, lifting the portion 45 of the handle 39** will cause the point to break the score line. To facilitate manufacturing the point may be radiused.

Conveniently the handle 40 is of out-of-round ring shape comprising an arcuate base bar 42 integrally attached to the post 41 at a secure but somewhat reduced mass, resilient neck 43. As best seen in FIG. 3, the bar 42 is of substantially parallel arcuate shape to the adjacent arcuate wall defining the wall 35 and desirably extends symmetrically from opposite sides of the post 41. At its opposite ends, the arcuate bar 42 joins, by means of arcuate connections 44, a substantially straight digitally engageable pull bar 45 extending in parallel adjacency to the partition 25 in the at rest position of the handle 40 wherein it lies in a plane generally parallel to the crown panel 19. In the at rest position of the handle 39, as best seen in FIG. 2, the top surface of the handle lies freely under the closed cover 21.

Because the reaction or thickness of the crown panel 19 should be as thin as is practical and economical, and when it becomes necessary to remove the stopper 37, considerable pulling force thereon must be exerted through the handle 39, it is desirable to reinforce contiguous structures of the closure unit to avoid distortions that might be detrimental. Therefore, the lip 20 in the vicinity of the well 35 is substantially reinforced, as best visualized in FIG. 3. There is provided a wall thickening 47 providing the arcuate wall defining the well 35 and thus efficiently stiffening the area where the maximum pulling force is applied by the handle 39 when starting the breakaway of the stopper 37. For implementing such reinforcement, the opposite ends of the wall thickening 47 join the opposite ends of the partition 25 on vertical reinforcing beam thickenings 48. Through this arrangement the area of the closure 10 about the handle-enclosing well 35 is thoroughly reinforced against any distortion that might otherwise occur as a result of even the most vigorous force applied through the handle 39 in dislodging the stopper 37. The manner in which the handle 39 is manipulated to effect such stopper displacement is exemplified in FIG. 5.

Reinforcement of the portion of the cover 21 which overlies the well 35 and a seal between the cover in closed position and the wall about the well 35 is provided by means of a shaped rib 49 (FIGS. 2, 3, 5 and 9) which is located on the underside of the cover 21 and is dimensioned complementary to the horizontal cross sectional shape of wall surfaces defining the well 35. In the closed position of the cover 21, the rib 49 fits between well wall surfaces and the at rest or stored handle 39 within the well 35. Digital pressure to press the cover 21 against the seat 22 and into latching engagement of the latch ribs 32 and 33 will be firmly effective without significant distortion of the area of the cover against which the closure thrust force is applied.

Figure 9:
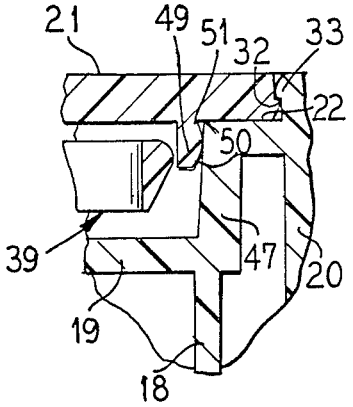
FIG. 9 is a fragmentary enlarged sectional detail view taken substantially along the line IX—IX in FIG. 2.

Sealing effectiveness of the reinforcing rib 49 is attained by having it bear closely slideable against the well wall as best seen in FIG. 9. To facilitate such sealing bearing engagement, the bearing surface of the rib 49 is desirably formed curvate in cross section as noted at 50. The rib 49 engages the wall surface with a resilient thrust enhanced by an at least slightly resiliently flexible integral connection of the rib with the cover panel 21 at a connection neck thinning 51.

When it is desired to gain access to the handle 39, digital pressure applied to the portion of the cover 21 over the cavity 24 causes the overlying portion of the cover 21 to be pressed into the cavity 24. This causes the hinged portion of the cover panel overlying the well 35 to swing into an upstanding clearance position as shown in FIG. 5, where the cover may remain or the cover may be pulled fully open as shown in FIGS. 3 and 4. Then the handle 39 may be grasped by the pull bar 45 and lifted or swung bendably out of the well 35, and by applying ripout force to the handle as indicated by directional arrow in FIG. 5, the stopper 37 is pulled free from its weakened connection 38 with the crown panel 19. With the cover 21 either in the upright open position of FIG. 5 or the radial open position of FIGS. 3 and 4 dispensing may be effected through the opening 28. Contents remaining in the associated container 12 after a partial dispensing thereof can be protected by reclosing the cover 21. By having the reinforcing rib 49 snuggly fully engaging the surrounding wall surface defining the well 35 in the closed position of the cover 21, an efficient seal against unintentional spilling of container contents through the opened opening 28 and the well 35 is provided.

It will be apparent that various modifications and/or additions may be made in the device of the invention without departing from the essential feature of novelty involved, which are intended to be defined and secured by the appended claims.

What is claimed:

1. A tamper evident container closure comprising a skirt for attachment to the mouth end of a container and a closure crown panel supported by said skirt, and a cover on the closure over the crown panel displaceable for exposing the crown panel;

a well on the closure crown panel normally closed by said cover, said well having a floor comprising part of the crown panel and with a dispensing opening in said floor;

said crown panel having a lip structure projecting above said crown panel and carrying said cover displaceably;

said crown panel has a partition dividing said well from a cavity defined by said partition and said lip; said crown panel having reinforcing means associated with said partition within said cavity;

a rip-out tamper evident element fixed in closing relation to said opening and requiring destructive removal for dispensing access to said opening;

a digitally manipulatable handle attached to said element and confined within said well in the closed condition of said cover and accessible when the cover is displaced from said well for pulling the handle out of the well and forcibly destructibly displacing said element from said opening; and said cover having hingedly connected portions one portion of which covers said cavity and a second portion which covers said well; a hinge connecting said one cover portion to said lip, and said second cover portion fulcruming on said partition and swinging open when said one cover portion is pressed into said cavity.

2. The closure of claim 1 comprising hinge means provided on said cover to permit said cover second portion to open when said cover first portion is pressed into said cavity, and a rib and a groove detent latch means provided in said cover second portion and said partition to prevent undesired closing of said cover second portion when in the open position.

3. The closure of claim 1 wherein said handle extends substantially parallel to said element, a post extending substantially vertically from the floor and having one end attached to said element and the other end attached to said handle.

4. The closure of claim 3 wherein said post and said element are integral with said post extending from a periphery of said element and said element being attached to said floor by a weakened line about said element and about an outer surface of said post where said post extends from said element.

5. The closure of claim 1 wherein said second cover portion has sealing means thereon to sealingly engage well surfaces when said cover is in a closed position.

6. A tamper evident container closure according to claim 5 wherein said sealing means comprises a reinforcing rib on said second cover portion.

7. The closure of claim 6 wherein said well is defined by a reinforcing structure surrounding said well, said reinforcing rib has outer curved surface areas, and said rib on said cover second portion is complementary to said reinforcing structure such that the curved surfaces sealingly engage the reinforcing structure when the cover is closed.

8. A tamper evident container closure comprising a molded one-piece unitary plastic construction;

a skirt for attachment to the mouth end of a container;

a closure crown panel supported by said skirt;

a lip projecting from and above said crown panel in general alignment with said skirt;

a partition extending substantially diametrically on and across said panel and connected at its opposite ends to said lip and dividing the area above said panel into a well on one side of the partition and a cavity on the opposite side of the partition;

a circular dispensing opening in the well portion of said panel and offset from said partition toward said lip;

a cover over said well and cavity and displaceable for exposing said well;

said panel having reinforcing means associated with said partition within said cavity;

a disk closing said dispensing opening and secured fixedly to said panel about said opening by destructible separable means;

a digitally manipulatable handle attached to said disk and confined within said well in the closed position of said cover and accessible when the cover is displaced from over said well for digital manipulation for forcibly destructibly displacing said disk from said opening; and said cover has hingedly connected portions, one of which portions covers said cavity and a second of which portions covers said well, a hinge connecting said one cover portion to said lip remote from side partition, and said second cover portion fulcruming on said partition when said one cover is pressed into said cavity.

9. The closure of claim 8 comprising hinge means provided on said cover to permit said cover second portion to open when said cover first portion is pressed into said cavity, and a rib and a groove detent latch means provided in said cover second portion and said partition to prevent undesired closing of said cover second portion when in the open position.

10. The closure of claim 8 wherein said handle extends substantially parallel to said disk, a post extending substantially vertically from the floor and having one end attached to said disk and the other end attached to said handle.

11. The closure of claim 10 wherein said post and said disk are integral with said post extending from a periphery of said disk and said disk being attached to said floor by a weakened line about said disk and about an outer surface of said post where said post extends from said disk.

12. The closure of claim 8 wherein said second cover portion has sealing means thereon to sealingly engage well surfaces when said cover is in a closed position.

13. A tamper evident container closure according to claim 12 wherein said second cover portion has reinforcing sealing ribs engageable with surface areas about said well in the closed position of said second cover portion over said well.

14. The closure of claim 13 wherein said well is defined by a reinforcing structure surrounding said well, said reinforcing ribs have outer curved surface areas, and said ribs on said cover second portion are complementary to said reinforcing structure such that the curved surfaces sealingly engage the reinforcing structure when the cover is closed.

* * * * *